US010822162B2

(12) United States Patent
McGonnell et al.

(10) Patent No.: US 10,822,162 B2
(45) Date of Patent: Nov. 3, 2020

(54) SHIPPER BAG PROVIDING FLUID-ASSISTED CONTAINER EVACUATION

(71) Applicant: A.R. Arena Products, Inc., Rochester, NY (US)

(72) Inventors: Aaron McGonnell, Rochester, NY (US); Donald E. Wilcox, Rochester, NY (US)

(73) Assignee: A.R. Arena Products, Inc., Rochester, NY (US)

( * ) Notice: Subject to any disclaimer, the term of this patent is extended or adjusted under 35 U.S.C. 154(b) by 221 days.

(21) Appl. No.: 15/666,972

(22) Filed: Aug. 2, 2017

(65) Prior Publication Data

US 2019/0039822 A1 Feb. 7, 2019

(51) Int. Cl.
*B65D 77/06* (2006.01)
*B65D 88/62* (2006.01)

(52) U.S. Cl.
CPC ..... *B65D 88/62* (2013.01); *B65D 77/06* (2013.01); *B65D 2231/001* (2013.01)

(58) Field of Classification Search
CPC .. B65D 83/0061; B65D 77/06; B65D 77/065; B67D 1/0462; B67D 7/0244
USPC ..... 206/522; 222/95, 386.5; 383/3, 906; 224/148.1, 148.2; 604/141
See application file for complete search history.

(56) References Cited

U.S. PATENT DOCUMENTS 2,105,160 A 1/1938 Piqueres
2,333,587 A 11/1943 Salfisberg
2,347,379 A 4/1944 Teeter
2,446,308 A 8/1948 Smith
2,799,314 A 7/1957 Andre et al.
2,930,423 A 3/1960 Cunningham et al.
(Continued)

FOREIGN PATENT DOCUMENTS

BE 898136 3/1984
BE 1007241 5/1995
(Continued)

OTHER PUBLICATIONS

Screen shots of youtube video titled—Discharging high viscous products with High Viscosity liner—https://www.youtube.com/watch?v=H4CVrYhdAgk—accessed Sep. 13, 2018; 4 pages.
(Continued)

*Primary Examiner* — Jes F Pascua
*Assistant Examiner* — Nina K Attel
(74) *Attorney, Agent, or Firm* — Bond, Schoeneck & King, PLLC; Jeffrey Powers

(57) ABSTRACT

A shipper bag having at least one fluid chamber to facilitate fluid-assisted container evacuation from a product discharge zone of a product chamber. The product chamber is formed by at least one inner ply, and the least one fluid chamber disposed between the at least one inner ply and at least one second ply. The at least one fluid chamber has at least one seam connecting the at least one inner ply to the at least one second ply such that, when in the inflated state, the at least one seam comprises a first seam that extends from a location proximate the product discharge zone to a location proximate a location opposite the discharge zone. The bag may have two or more fluid compartments.

15 Claims, 11 Drawing Sheets

(56) References Cited

U.S. PATENT DOCUMENTS

| | | | | |
|---|---|---|---|---|
| 2,950,037 | A | 8/1960 | Rene | |
| 2,951,628 | A | 9/1960 | Jean | |
| 2,956,839 | A | 10/1960 | Hermanns | |
| 3,067,810 | A | 12/1962 | Mozic | |
| 3,139,998 | A | 7/1964 | Seaman | |
| 3,170,600 | A | 2/1965 | Pierson | |
| 3,172,556 | A | 3/1965 | Stiefel | |
| 3,191,793 | A | 6/1965 | Morrison | |
| 3,199,726 | A | 8/1965 | Pierson | |
| 3,224,640 | A | 12/1965 | Schneider et al. | |
| 3,243,084 | A | 3/1966 | Stefner | |
| 3,275,197 | A | 9/1966 | Ingulf | |
| 3,351,235 | A | 11/1967 | Paton | |
| 3,396,762 | A | 8/1968 | Paton | |
| 3,404,813 | A | 10/1968 | Waxman | |
| 3,421,663 | A | 1/1969 | Paton | |
| 3,421,665 | A | 1/1969 | Paton | |
| 3,504,827 | A | 4/1970 | Larson | |
| 3,508,686 | A | 4/1970 | Goldberg | |
| 3,510,142 | A | 5/1970 | Erke | |
| 3,590,888 | A | 7/1971 | Coleman | |
| 3,709,426 | A | 1/1973 | Farkas | |
| 3,802,470 | A | 4/1974 | Coleman | |
| 3,941,258 | A | 3/1976 | Ide | |
| 4,085,865 | A | 4/1978 | Thompson et al. | |
| 4,098,434 | A | 7/1978 | Uhlig | |
| 4,213,545 | A | 7/1980 | Thompson et al. | |
| 4,270,533 | A | 6/1981 | Andreas | |
| 4,421,250 | A | 12/1983 | Bonerb | |
| 4,449,646 | A | 5/1984 | Bonerb et al. | |
| 4,476,998 | A | 10/1984 | Bonerb et al. | |
| 4,487,335 | A | 12/1984 | Bonerb | |
| 4,548,321 | A | 10/1985 | Mockesch et al. | |
| 4,574,984 | A | 3/1986 | Bonerb | |
| 4,583,663 | A | 4/1986 | Bonerb | |
| H000080 | H | 7/1986 | Lewis | |
| RE32,232 | E | 8/1986 | Bonerb et al. | |
| 4,658,989 | A | 4/1987 | Bonerb | |
| 4,673,112 | A | 6/1987 | Bonerb | |
| 4,728,004 | A | 3/1988 | Bonerb | |
| 4,796,788 | A | 1/1989 | Bond | |
| 5,060,826 | A | 10/1991 | Coleman | |
| 5,096,092 | A | 3/1992 | Devine | |
| 5,332,121 | A | 7/1994 | Schmidt et al. | |
| 5,335,820 | A | 8/1994 | Christianson | |
| 5,344,048 | A | 9/1994 | Bonerb | |
| 5,407,629 | A | 4/1995 | Schmidt et al. | |
| 5,487,470 | A | 1/1996 | Pharo | |
| 5,489,037 | A | 2/1996 | Stopper | |
| 5,494,394 | A | 2/1996 | Podd | |
| 5,531,361 | A | 7/1996 | Podd | |
| 5,551,601 | A | 9/1996 | Camm et al. | |
| 5,636,764 | A | 6/1997 | Bonerb | |
| 5,685,688 | A | 11/1997 | Podd et al. | |
| 5,765,723 | A | 6/1998 | Wilcox | |
| 5,788,121 | A | 8/1998 | Sasaki et al. | |
| 5,944,470 | A | 8/1999 | Bonerb | |
| 6,120,181 | A | 9/2000 | Wilcox | |
| 6,186,360 | B1 | 2/2001 | Becker et al. | |
| 6,234,351 | B1 | 5/2001 | Wilcox | |
| 6,427,873 | B2 | 8/2002 | Wilcox | |
| 6,467,652 | B2 | 10/2002 | Wilcox et al. | |
| 6,481,598 | B1 | 11/2002 | Thornsen | |
| 6,786,364 | B2 | 9/2004 | McBride | |
| 7,086,428 | B2 | 8/2006 | Schroeder et al. | |
| 7,353,849 | B2 | 4/2008 | Schroeder et al. | |
| 7,597,525 | B2 | 6/2009 | McMahon et al. | |
| 7,798,711 | B2 | 9/2010 | Plunkett et al. | |
| 7,845,600 | B2 | 12/2010 | Kosich | |
| 7,954,670 | B2 | 6/2011 | Stuart | |
| 8,075,188 | B2 | 12/2011 | Plunkett et al. | |
| 8,083,105 | B2 * | 12/2011 | Reichert | A45F 3/20 220/703 |
| 8,141,750 | B2 | 3/2012 | Ingvarsson et al. | |
| 8,182,152 | B2 | 5/2012 | Plunkett et al. | |
| 8,590,740 | B2 | 11/2013 | Mauger et al. | |
| 9,016,555 | B2 | 4/2015 | Plunkett et al. | |
| 9,033,178 | B2 | 5/2015 | White | |
| 9,346,612 | B2 | 5/2016 | Plunkett et al. | |
| 9,701,445 | B2 | 7/2017 | Witthuhn et al. | |
| 9,850,054 | B2 | 12/2017 | Pansegrouw | |
| 9,862,540 | B2 | 1/2018 | Gillard | |
| 10,099,913 | B2 | 10/2018 | Oostveen | |
| 2001/0002675 | A1 | 6/2001 | Wilcox | |
| 2007/0048113 | A1 | 3/2007 | McMahon et al. | |
| 2007/0102428 | A1 | 5/2007 | Eamcharoenying | |
| 2008/0035519 | A1 * | 2/2008 | Swartz | B65D 31/145 206/522 |
| 2008/0149664 | A1 | 6/2008 | Schroeder et al. | |
| 2008/0290117 | A1 | 11/2008 | Schroeder et al. | |
| 2008/0310766 | A1 | 12/2008 | Plunkett et al. | |
| 2009/0008410 | A1 | 1/2009 | Kosich | |
| 2009/0212071 | A1 | 8/2009 | Tom et al. | |
| 2011/0248035 | A1 | 10/2011 | Peirsman et al. | |
| 2012/0000807 | A1 * | 1/2012 | Scarbrough | A45C 7/0081 206/522 |
| 2013/0019989 | A1 | 1/2013 | Pansegrouw | |
| 2013/0036711 | A1 | 2/2013 | Scudder et al. | |
| 2013/0092706 | A1 | 4/2013 | Ross | |
| 2013/0239523 | A1 | 9/2013 | Scudder et al. | |
| 2014/0034671 | A1 | 2/2014 | Chism et al. | |
| 2014/0131380 | A1 | 5/2014 | Pethe et al. | |
| 2015/0368039 | A1 | 12/2015 | Cochrum et al. | |
| 2016/0122107 | A1 * | 5/2016 | Pansegrouw | B65B 31/00 220/495.06 |
| 2016/0200503 | A1 | 7/2016 | Zaleski | |
| 2017/0008697 | A1 | 1/2017 | Gillard | |
| 2018/0222670 | A1 | 8/2018 | Bonerb | |

FOREIGN PATENT DOCUMENTS

| | | |
|---|---|---|
| DE | 2914272 | 10/1980 |
| DE | 2229692 | 2/1981 |
| DE | 3502455 | 10/1986 |
| DE | 4000427 | 7/1991 |
| DE | 19513223 | 10/1996 |
| EP | 0098322 | 1/1984 |
| EP | 0389191 | 9/1990 |
| EP | 0276994 | 12/1992 |
| EP | 0866000 | 5/2000 |
| FR | 1470658 | 2/1967 |
| FR | 2316151 | 1/1977 |
| FR | 2375113 | 7/1978 |
| GB | 794125 | 4/1958 |
| GB | 855804 | 12/1960 |
| GB | 2110192 | 6/1983 |
| GB | 2172261 | 9/1986 |
| GB | 2268231 | 1/1994 |
| GB | 2356854 | 6/2001 |
| JP | 2001180788 | 7/2001 |
| SU | 878672 | 11/1981 |
| WO | 8203838 | 11/1982 |
| WO | 004242 | 12/1982 |
| WO | 012196 | 8/1991 |
| WO | 2011119055 | 9/2011 |

OTHER PUBLICATIONS

Screen shots of web site—Anderson Lid Company (ALC)—http://andersonlid.com/product/liquid-liner/—accessed Sep. 13, 2018; 3 pages.

Screen shots of Chep—Bulk Liquid Shipping Container Accessories—http://global.chep.com/Containers/IBCs/Liquid/liquid_container_accessories/—accessed Sep. 7, 2018; 4 pages.

Keane, Christine, Images of Bag having Five Air Chambers in an Inflated State, and Related Statement, Statement dated Nov. 30, 2018; 16 pages.

(56) References Cited

OTHER PUBLICATIONS

IBC Liners, "Air Assist Intermediate Bulk Container Liners," CDF Corporation, https://www.cdfl.com/flexible-packaging/ibc-air-assist-liners/, Accessed Aug. 31, 2017, pp. 1-6.

* cited by examiner

SHIPPER BAG PROVIDING FLUID-ASSISTED CONTAINER EVACUATION

FIELD

Shipper bags for use in bulk containers, and in particular shipper bags inflatable with fluid.

BACKGROUND

In the bulk product shipping industry, plastic bags are commonly used in containers (e.g., an intermediate bulk shipping container (IBC)) to ship quantities of liquids, pastes, granular products, powders, and other flowable and semi-flowable bulk products (referred to herein as product). These containers can be handled by forklifts and arranged conveniently in trucks, railroad cars, ships, or planes where each container holds, for example, around 300 gallons of flowable product. In particular the product is located in a plastic shipper bag (also commonly referred to as a liner bag). Shipper bags can be of a fitted-type, where size and shape of the bag is selected to correspond to a container, or can be of a pillow-type where the size and shape do not correspond to the container and a bag may fold to fit within a container as the bag is inflated.

As the product is emptied from a bag through a drain, substantial quantities of the product can be trapped in the bag as residual, resulting in waste that remains in the bag after all product that can be removed has been removed. Waste exists even where pumps are connected to the bags to assist emptying, and is especially true for more viscous products, such as drywall paste and mayonnaise or granular products. Residual in bulk product shipper bags results when the bag is evacuated and collapses, which leaves folds and wrinkles as well as corners where product is trapped. In addition to folds and wrinkles causing trapping of product, folds on the bottom near the drain can be sucked against the drain port causing the pump to fail to operate properly.

Use of bags having multiple plies is described in U.S. Pat. No. 6,467,652. These bags reduce residual and reduce the need for human intervention during emptying of container. Such multi-ply bags have a product chamber in which product is maintained, and a fluid chamber into which air can be pumped to achieve fluid-assisted removal of product from the container. Such bags have seams that form multiple bag compartments resulting in a sump shape as air is pumped into the fluid chamber. The sump shape directs product to a product discharge zone at the bottom of the bag thereby reducing the residual product that tends to form a puddle at the bottom of a bag. The substance of U.S. Pat. No. 6,467,652 is hereby incorporated by reference herein. Other fluid-assisted, multi-chamber bags for removal of product from a product chamber are described in U.S. Pat. Nos. 6,120,181 and 7,954,670, and U.S. Publ. Patent Application No. 2013/0092706.

There remains a need to reduce the percentage of residual product left in the bag after evacuation is complete.

SUMMARY

The inventors have recognized that complete removal of product from a liner bag involves removal of the puddle at the bottom of the bag, and removal of product trapped in the remaining portions of a bag by wrinkles, folds and/or corners, all while reducing human intervention during removal. Bag material may comprise, for example, polyethylene, nylon, metalized plastic or metal foil.

Aspects of the present invention approach near-complete removal of product by facilitating draining from wrinkles folds, and/or corners. Aspects of the invention provide a fluid chamber (e.g. to hold air) extending from a location proximate a drain (or a product discharge zone) to a location proximate a location opposite the drain (or product discharge zone). Other aspects of the invention are directed to the fluid chamber having multiple compartments which are positioned such that, when the fluid chamber is inflated, the compartments form two or more interfaces (each interface formed between a corresponding two compartments) to squeeze product from between the chambers, each of the interfaces extending in a different direction than the other interfaces (i.e., the interfaces are non-coplanar). In certain embodiments, the presence of fluid in a compartment (and possibly one or more interfaces) at a location above the product (as would be achieved by having the seam defining a chamber extend to a location opposite a product discharge zone) allows the chambers to inflate prior to near-completion of the product emptying. Inflation above the product prior to near-complete removal of the product in such embodiments allows for drainage of product over greater time and a lessening of residual.

In accordance with one aspect of the present invention, there is provided a shipper bag having at least one fluid chamber to facilitate fluid-assisted container evacuation from a product discharge zone of a product chamber, the product chamber formed by at least one inner ply, and the least one fluid chamber disposed between the at least one inner ply and at least one second ply. The at least one fluid chamber has at least one seam connecting the at least one inner ply to the at least one second ply such that, when in the inflated state, the at least one seam comprises a first seam that extends from a location proximate the product discharge zone to a location proximate a location opposite the discharge zone.

In some embodiments, the first seam separates a first compartment and a second compartment, the seam having an opening that fluidly couples the first compartment to the second compartment.

In some embodiments, the first seam separates a first chamber and a second chamber.

The at least one seam may comprise a second seam connecting the at least one inner ply to the at least one second ply to form a third compartment and a fourth compartment.

In some embodiments, the first compartment and the second compartment are separated from the third compartment and the fourth compartment by a fold line.

In some embodiments, the at least one fluid chamber is disposed over at least 50% of the surface area of the product chamber when the bag is an uninflated state; and in some embodiments, the at least one fluid chamber is disposed over at least 75% of the surface area of the product chamber when the bag is an uninflated state.

In some embodiments, the first compartment and the second compartment are on a same face of the bag. In some embodiments, the first compartment and the second compartment are on a front face of the bag, and the third compartment and the fourth compartment are on a back face of the bag.

In some embodiments, wherein the first compartment, second compartment, third compartment and fourth compartment form non-coplanar interfaces when the bag is in an inflated state.

In some embodiments, the bag has a perimeter seal in the product discharge zone, the perimeter seal shaped as a concavity facing the interior of the bag. The concavity may be formed as plurality of straight line portions of the perimeter seal.

In some embodiments, the bag has at least one perimeter seal, wherein a first portion of the at least one perimeter seal has an interior surface that is angled to face a top of the bag, and a second portion of the at least one perimeter seal having an interior surface that is facing the first portion and is angled to face the top of the bag.

The bag may be in a combination with a container, the product discharge zone disposed at the bottom of the container, the bag being inflated such that the first portion contacts a top of a first side of the container and the second portion contacts a top of a second side of the container.

The bag may be a fitted bag.

The term " product chamber" is defined herein to mean a fully enclosed vessel intended to hold product, the vessel having at least one opening having a closure (e.g., a cover or other sealing configuration) to allow selective input and/or discharge of product from the vessel.

The term "fluid chamber" is defined herein as a fully enclosed vessel intended to hold a fluid and positioned to facilitate discharge of product from the product chamber, and having at least one opening to allow input of fluid.

The term "compartment" is defined herein as a portion of a fluid chamber defined, in part, by a seam having a fixed opening or openings. The fixed opening disposed to allow flow of fluid to and from a second compartment. A compartment may be defined, in part, by a multi-ply fold line.

The term "fixed opening" is defined herein as an opening that is not coverable, for example, due to inaccessibility.

The term "location opposite" means a location on the bag that is furthest from a first location (e.g., a product discharge zone), measured along a straight line extending between the first location and a center of mass of the fluid in all of the fluid chambers as determined when the chamber are fully inflated (and for purposes of determining a center of mass assumes the fluid has uniform density).

A second location is "proximate a location opposite" if the distance from the location opposite to the second location is within 20% of the length of the straight line used to determine the location opposite. In some embodiments, the second location is within 15% or 10% of the length of the straight line.

The term "product discharge zone" refers to a location on a bag where product is directed for removal from the bag. A drain may be present at the product discharge zone; alternatively, for example, a dip tube may be extended into the product discharge zone for removal by a pump.

The term "top" refers to locations on a bag opposed to where gravity pulls product within a product chamber when a bag is operationally located in a container. The term "above" refers to a location tending in the direction of the top.

The term "bottom" refers to locations on a bag where gravity pulls product within a product chamber when a bag is operationally located in a container. The term "below" refers to a location tending in the direction of the bottom.

These and other aspects of the present invention will become apparent upon a review of the following detailed description and the claims appended thereto.

DETAILED DESCRIPTION

Figure 1A:
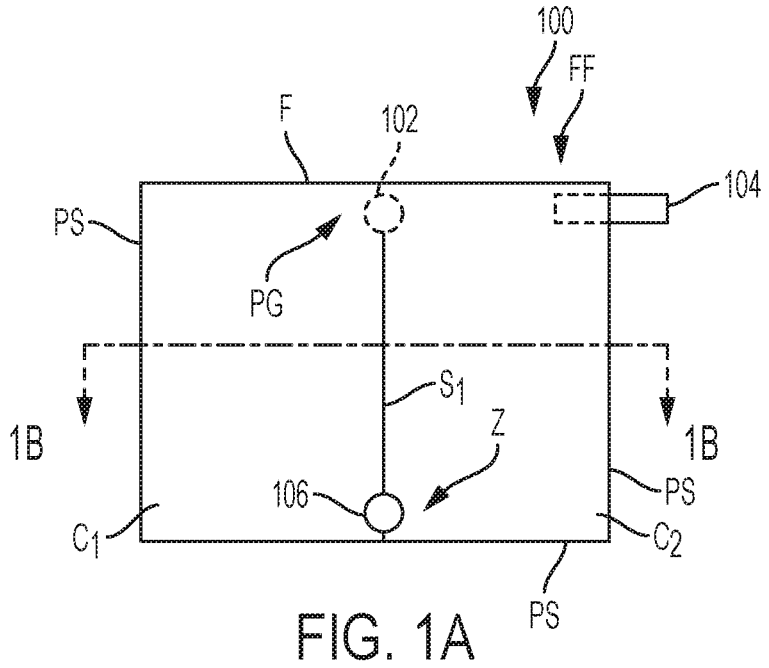
FIG. 1A is a front illustration of a shipper bag embodiment according to aspects of the present invention.
Figure 1B:
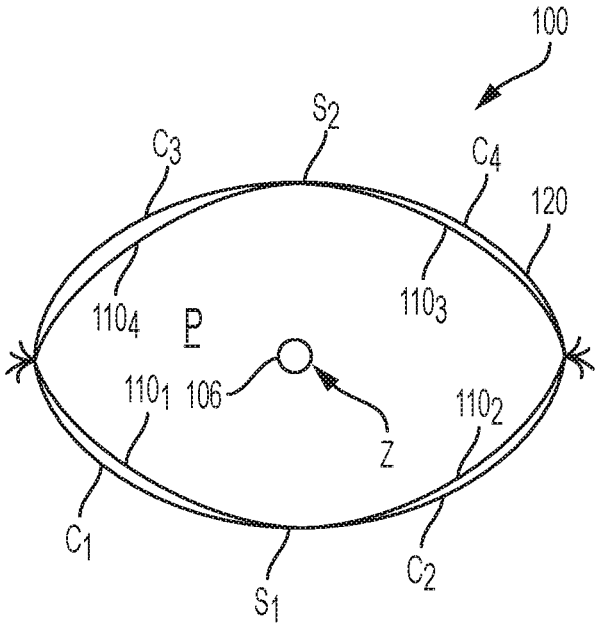
FIGS. 1B and 1C are cross sectional illustrations of the FIG. 1A embodiment taken along line 1B-1B in an uninflated state with product in the product chamber and an inflated state with product substantially removed from the product chamber, respectively.
Figure 1C:
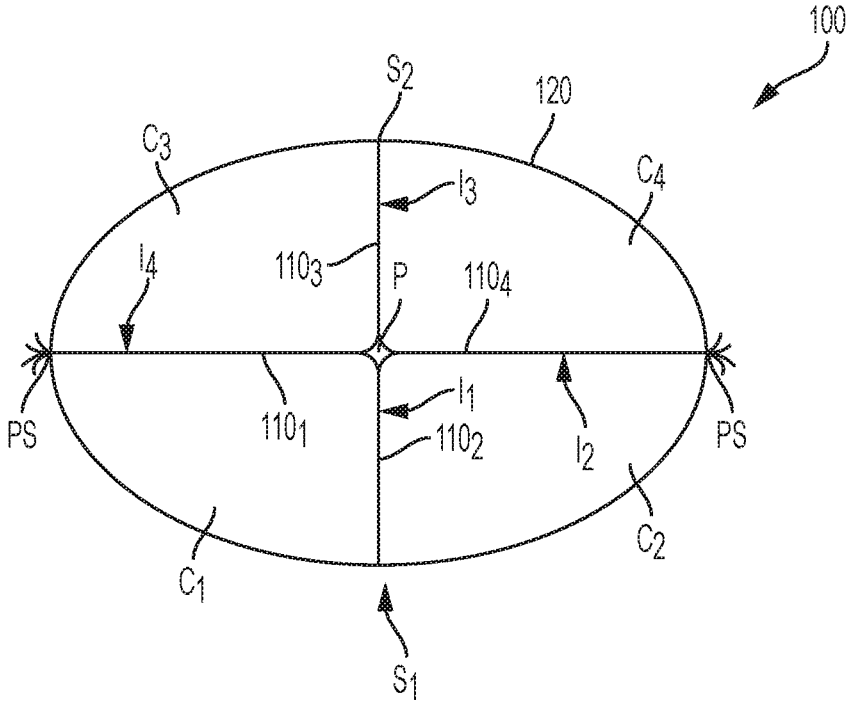

FIG. 1A is a front illustration of an embodiment of a shipper bag 100 according to aspects of the present invention. FIGS. 1B and 1C are cross sectional illustrations of shipper bag 100, illustrating the bag in an uninflated state and an inflated state, respectively. As set forth below, shipper bag 100 facilitates fluid-assisted container evacuation from a product discharge zone Z using compartments $C_1$-$C_4$ . Shipper bag 100 comprises at least one inner ply (inner ply 110 having sections $\mathbf{100}_1$-$\mathbf{100}_4$) and at least one second ply (second ply 120). Bag 100 is symmetric such that the back face (not shown) is the same as the front face FF as shown in FIG. 1A other than the presence of product inlet 102 and drain 106.

Inner ply 110 forms a product chamber P. In bag 100, a single inner ply 110 is folded (described with reference to FIG. 1E below) to form product chamber P in which a product is maintained, for example during shipping or storage of a product.

At least one fluid chamber is present between inner ply 110 and second ply 120 comprising compartments $C_1$-$C_4$. The fluid is typically a gas (e.g., air) however other suitable fluids (gases or liquids) may be used to shape the compartments in a manner as set forth below. In the embodiment illustrated in FIGS. 1A and 1B, single inner ply 100 and single second ply 200 form the fluid chamber. In other embodiments, two or more inner plies and two or more second plies can be sealed together to form one or more fluid chambers. Compartments $C_1$-$C_4$ are fluidly coupled together via passage PG and at fold line F where the plies allow fluid flow between the compartments.

Product chamber P has at least one product inlet 102. Product inlet 102 extends from an exterior of the completed bag into product chamber P to permit filling of the product chamber P with product. At least one fluid chamber F has at least one fluid inlet 104. Fluid inlet 104 extends from an exterior of the completed bag into fluid chamber to permit filling of fluid chamber F with fluid. Introduction of fluid into chamber F causes filling of chambers $C_1$-$C_4$ as described below. Although one fluid inlet 104 is illustrated in the FIG. 1, one or more fluid inlets may be present, for example, one for each fluid chamber.

Interply seams attaching an inner ply to a second ply can be used to affect the shape of the fluid chamber as the fluid chamber is filled and the shape of the product chamber when in its filled state. For example, the seams form fluid compartments $C_1$-$C_4$. The seams and compartments may form a product discharge zone as described in U.S. Pat. No. 6,467,652. According to aspects of the present invention, at least one seam connects at least one inner ply to at least one second ply, and the at least one seam divides at least one fluid chamber into at least two compartments. According to further aspects of the present invention, when in the inflated state, the at least one seam extends from a location proximate the product discharge zone to a location proximate a location opposite the discharge zone. A seam that is proximate a product discharge zone typically has an end within the suction zone of a drain as determined by a suction applied to the zone (e.g., by a syphon or a pump). Typically product discharge zone Z is determined as an area within 4 times (or 3 times or 2 times) the diameter of the discharge opening (e.g., the diameter of a drain or a dip tube). The terms "location opposite" and "proximate a location opposite" are defined above.

An advantage of embodiments according to aspects of the invention is that the fluid chamber covers a greater portion of the surface area of the product chamber than conventional shipper bags having fluid-assisted evacuation. In some embodiments, the at least one fluid chamber is disposed over at least 50% of the surface area of the product chamber when the bag is an uninflated state. In some embodiments, the at least one fluid chamber is disposed over at least 75% of the surface area of the product chamber when the bag is an uninflated state. In some embodiments, approaching 100% is desirable (shown in FIG. 5A).

In the embodiment shown in FIGS. 1A and 1B, a first interply seam $S_1$ is formed on the front of bag 100 and a second interply seam $S_2$ is formed on the back of the shipper bag. When the bag is inflated, seam $S_1$ extends from a location proximate the product discharge zone to a location proximate a location opposite the discharge zone Z. The first seam $S_1$ (along with perimeter seams PS and fold line F) forms two compartments $C_1$ and $C_2$ on the front of the bag and the second seam $S_2$ (shown in FIG. 1E; along with perimeter seams PS and fold line F) forms two compartments $C_3$ and $C_4$ on the back of the bag, for a total of four compartments. Compartments $C_1$-$C_4$ extend further than the seams, to fold line F.

The four compartments of bag 100 are arranged to form four interfaces $I_1$-$I_4$ between the four compartments. Neighboring compartments in the inflated state are disposed relatively closely together such that the space between the compartments is limited and, as the fluid chambers are filled, the chambers press against one another at interfaces $I_1$-$I_4$ to squeeze product from the bag. In some embodiments, adjacent chambers share a common seam. As illustrated, interfaces $I_1$ and $I_3$ extend in a different direction than interfaces $I_2$ and $I_4$ (e.g., the interfaces $I_1$ and $I_3$ are non-coplanar with interfaces $I_2$ and $I_4$).

Although squeezing may be one mechanism by which fluid is directed toward the fluid discharge zone (illustrated by drain 106), other mechanisms may direct fluid toward the fluid discharge zone. Such mechanisms may work in combination with gravity to direct fluid toward the discharge zone. For example, a single seam may be present between two adjacent compartments such that, upon inflation the compartments, the compartments contact one another at respective interfaces. By forming interfaces between compartments above the product discharge zone the effects of the compartments/interfaces allow for enhanced product evacuation of product chamber beyond that which would be provided by forming a sump in the product discharge zone.

A discharge zone may comprise a drain or may facilitate the placement of a dip tube into the product discharge zone as described in U.S. Pat. No. 6,467,652. Discharge of product from the discharge zone may occur via gravity, pumping through a drain in the discharge zone or pumping through an outlet that is outside of the discharge zone (e.g., opposite the discharge zone). As described in in U.S. Pat. No. 6,467,652 chambers may form a sump to direct product to the product discharge zone. A single opening may be used as a product inlet and a product outlet.

Figure 1D:
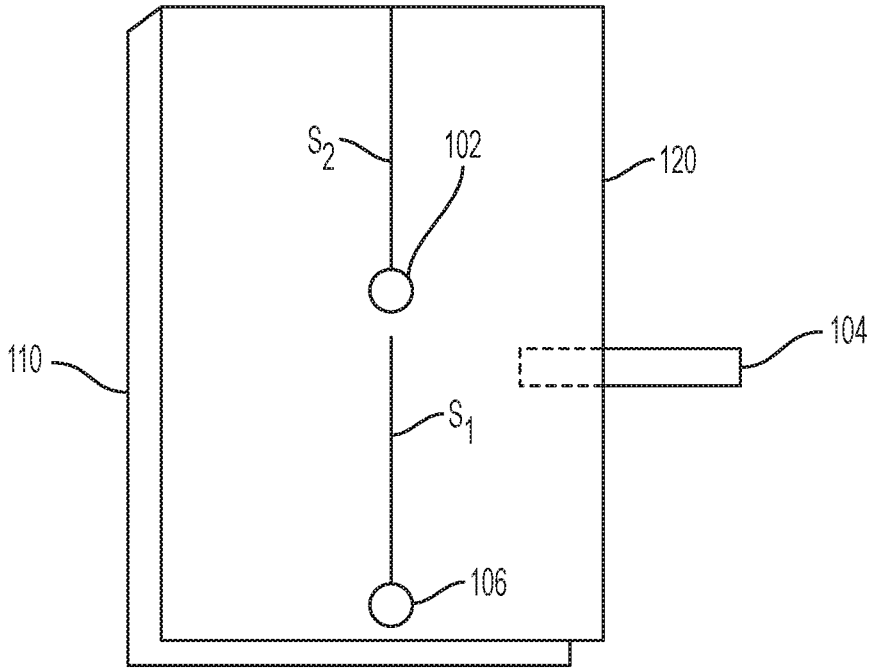
FIGS. 1D-1E are illustrations of various states of manufacture of the shipper bag illustrated in FIG. 1A.
Figure 1E:
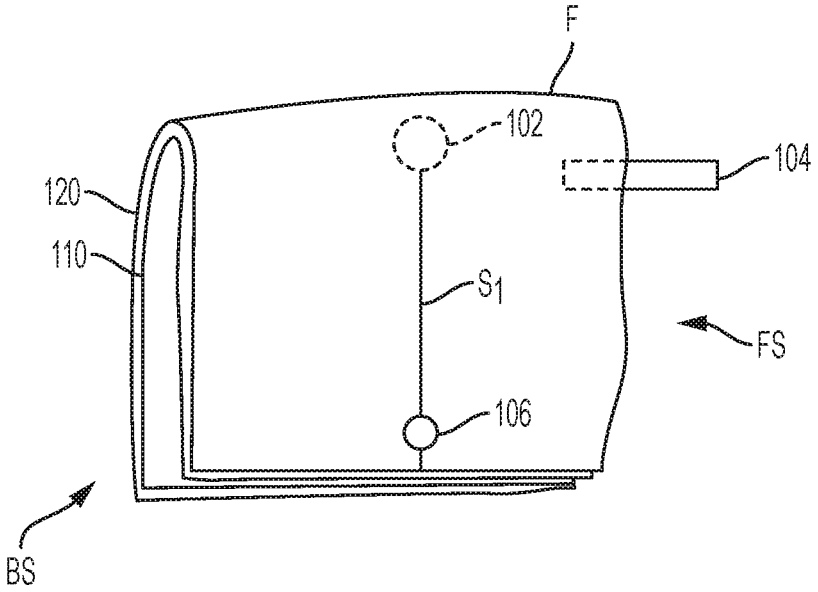

FIGS. 1D-1E are illustrations of various states of manufacture of the shipper bag illustrated in FIGS. 1A-1C. As shown in FIG. 1D, a sheet of product forming first ply 110 and a sheet of product forming second ply 120 are disposed to face one another. Product inlet 102 and a drain 106 are inserted through both plies 110 and 120 to access the product chamber in the finally formed bag. A fluid inlet 104 (e.g., Teflon tube) is located between first ply 110 and second ply 120 to inflate the completed formed bag.

As shown in FIG. 1E, first ply 110 and the second ply 120 are folded along a fold line F; and first seam $S_1$ is formed between first ply 110 and second ply 120 on the first face of the bag, and a second seam $S_2$ (shown in FIG. 1D) is formed between first ply 110 and second ply 120 on a second face of the bag. For example seams $S_1$ and $S_2$ may be formed with localized heating to melt plies 110 and 120 together, although other techniques of connecting plies 110 and 120 (e.g., adhesive) may be used to form the seams. Finally, with plies 110 and 120 folded along fold line F, the bag is sealed at locations around the perimeter such that portions of plies 110 and 120 forming the front of the bag and portions of plies 110 and 120 forming the back of the bag are sealed around their perimeter to form a perimeter seam PS (as shown in FIG. 1).

Figure 1F:
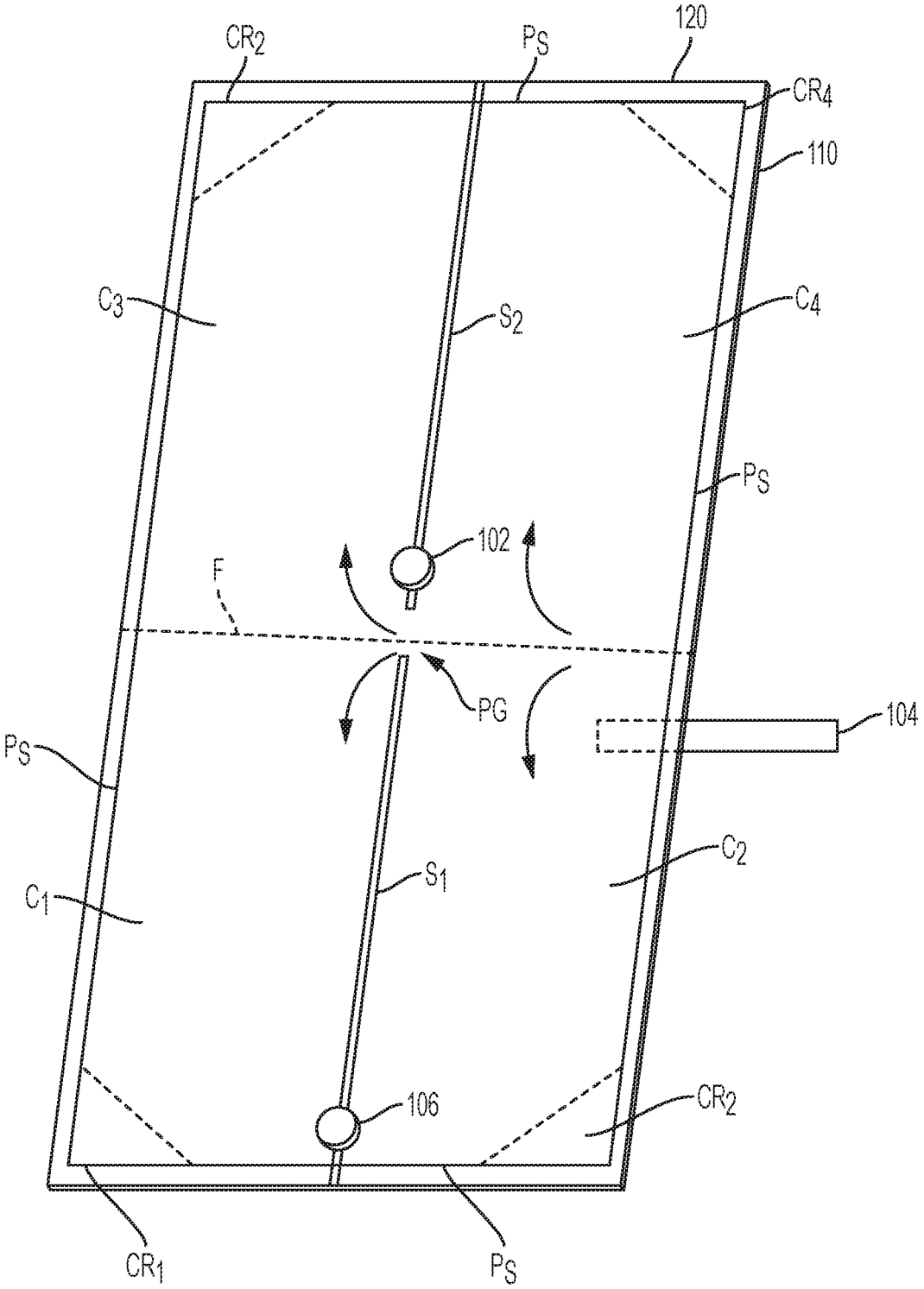
FIG. 1F is an unfolded version of the completed bag of FIG. 1A provided to facilitate description.

FIG. 1F is an unfolded completed bag 100 (as shown in FIG. 1A) provided to facilitate further description of the bag. In FIG. 1E, the perimeter seal PS is moved away from the edge of the bag for ease of illustration and description. As shown, chambers $C_1$-$C_4$ of bag 100 are fluidly coupled to one another at passage PG and fold line F such that fluid provided through inlet 104 reaches all four chambers $C_1$-$C_4$ as air pressure in the various chambers equilibrates. In the final product, chambers $C_1$-$C_2$ on the front face are separated from chambers $C_3$-$C_4$ on the back face, through fold F. Optionally, perimeter seam PS may be located as shown by dashed lines at corners $CR_1$-$CR_4$ to prevent product from entering and potentially being trapped in the corners $CR_1$-$CR_4$ or may be shaped shown in FIG. 1A.

Although the above embodiment was formed using two plies 110 and 120, three or more plies may be used. In embodiments having three or more plies, the innermost ply typically forms the product chamber, and the fluid chambers may be formed between any of the plies, typically the innermost and an adjacent ply.

Figure 1G:
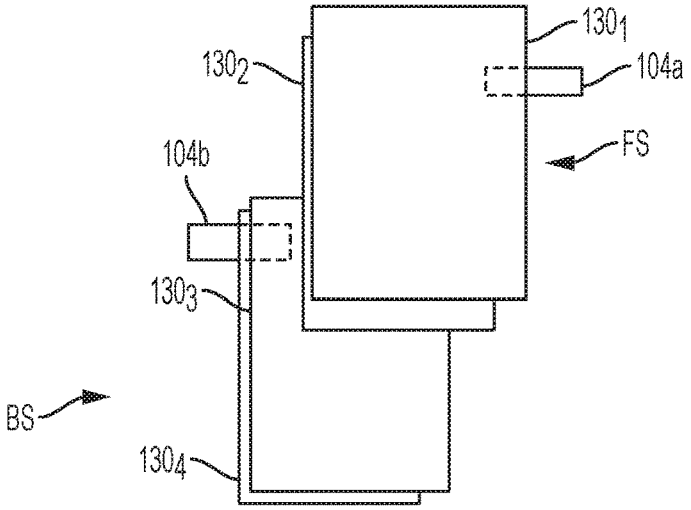
FIGS. 1G-1I are illustrations of an alternative method of manufacture of a shipper bag having four chambers similar to the shipper bag illustrated in FIGS. 1A-1C.
Figure 1H:
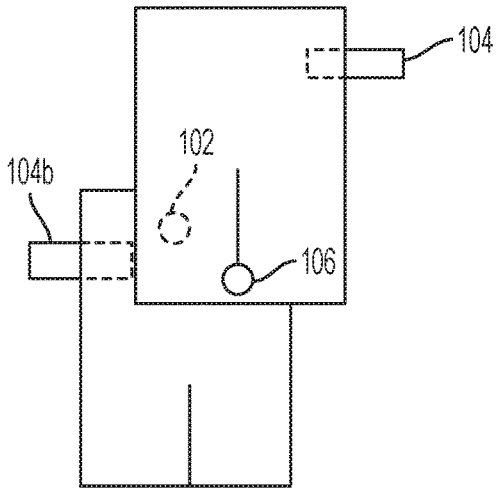
Figure 1I:
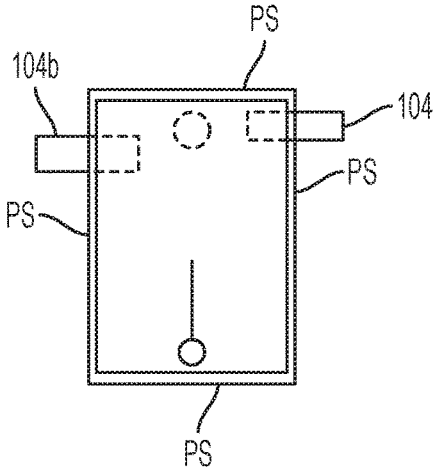

Although the embodiment of FIGS. 1A-1E was described as being formed with two plies folded along a fold F, in some embodiments, a bag (similar to bag 100 shown in FIG. 1) is formed which does not include a fold. As shown in FIGS. 1G-1I, no fold is present and separate sheets (e.g., sheets $\mathbf{130}_1$-$\mathbf{130}_4$) form the various plies of the front face FS and the back face BS of the bag. Fluid inlets 104*a* and 104*b* may be added to allow fluid to inflate a first fluid chamber (i.e., compartments $C_1$-$C_2$) and a second fluid chamber (i.e., compartments $C_3$-$C_4$) of the completed bag. Alternatively, if the front fluid compartments and the back fluid compartments are fluidly coupled (not shown), a single fluid inlet may be used to inflate all compartments $C_1$-$C_4$. As shown in FIG. 1H, sheets $\mathbf{130}_1$ and $\mathbf{130}_2$ are sealed together to from first seam $S_1$ and compartments $C_1$-$C_2$ and sheets $\mathbf{130}_3$-$\mathbf{130}_4$ are sealed together to form second seam $S_2$ and compartments $C_3$-$C_4$. A product inlet 102 and the drain 106 can be added to access product chamber P. As shown in FIG. 11, all of sheets $\mathbf{130}_1$-$\mathbf{130}_4$ are sealed together around the perimeter to from a perimeter seam PS. Perimeter seam PS connects the plies on the front face to the plies on the back face at the edges of the sheets of material.

Figure 2A:
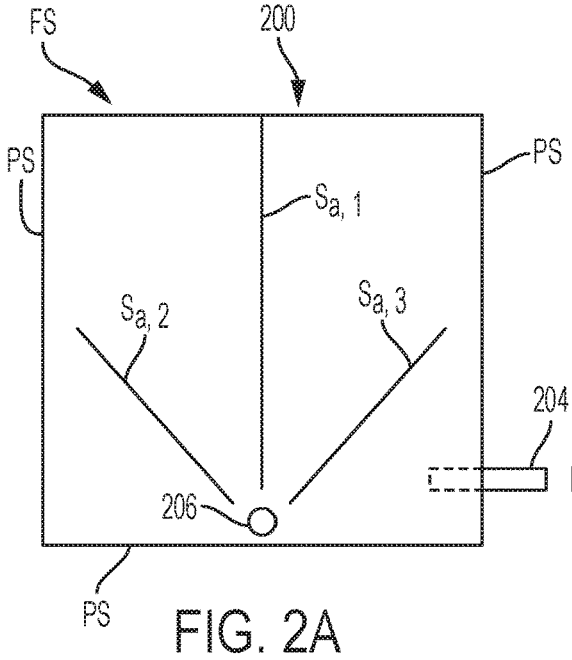
FIGS. 2A-2B are front and back views, respectively, of another embodiment of a shipper bag according to aspects of the present invention.
Figure 2B:
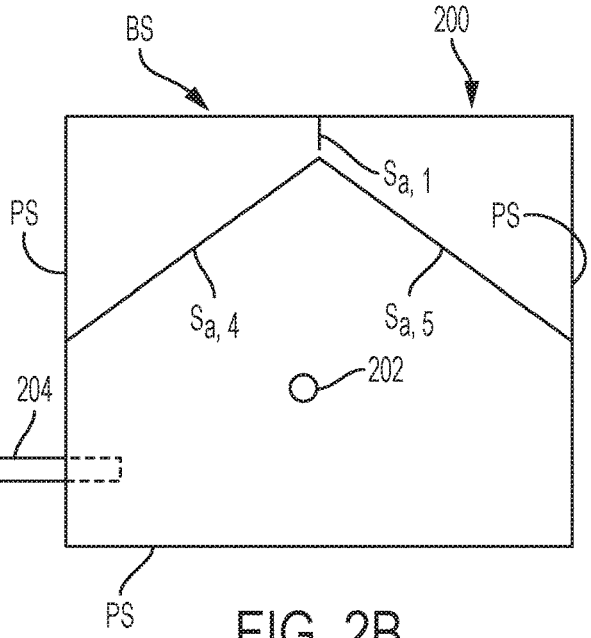
Figure 2C:
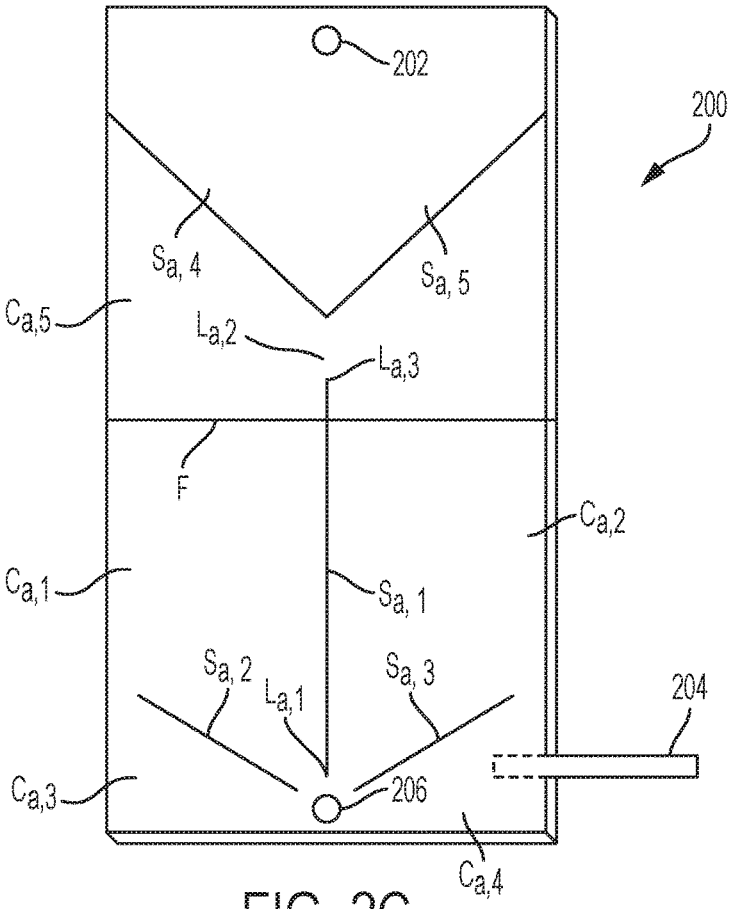
FIG. 2C is an illustration of the FIGS. 2A and 2B shipper bag, the bag being in an unfolded state.

FIGS. 2A-2B are front and back views, respectively, of another example of an embodiment of a shipper bag 200 according to aspects of the present invention. FIG. 2C is an illustration of the shipper bag 200 of FIGS. 2A and 2B in an unfolded state. Like bag 100 above, bag 200 includes two plies 210 and 220 with a plurality of interply seams $S_{a,1}$-$S_{a,5}$ formed between plies 210 and 220. Although the bag is formed with two plies, more than two plies may be used. A perimeter seal extends around the edges of the plies.

Also similar to bag 100, a drain 106 is disposed at a product discharge zone, the inner ply 110 forms a product chamber in a manner similar to that described above with reference to bag 100, and a fluid chamber between the inner ply 110 and the second ply 120 in a manner similar to that described above with reference to bag 100. There is a product chamber inlet 202, and a fluid chamber (comprising compartments $C_{a,1}$-$C_{a,6}$) having at least one fluid inlet 204.

Seam $S_{a,1}$ connects inner ply 210 to second ply 220. When in the inflated state seam $S_{a,1}$ extends from a location $L_{a,1}$ proximate the product discharge zone to a location $L_{a,3}$ proximate a location $L_{a,2}$ opposite the discharge zone. Seam $S_{a,1}$ divides at least one fluid chamber into two compartments $C_{a,1}$-$C_{a,2}$. Seams $S_{a,2}$ and $S_{a,3}$ (defining compartments $C_{a,3}$-$C_{a,4}$) form a sump.

As shown in FIG. 2C, two smaller compartments $C_{a,5}$-$C_{a,6}$ are present on the back face of bag 200. The bottoms of compartments $C_{a,3}$ and $C_{a,4}$ are formed by seams $S_{a,4}$-$S_{a,5}$. Compartments $C_{a,5}$ and $C_{a,6}$, as they are inflated, operate to keep material forming the bag (e.g., portions of plies 210 and 220) on the back face of the bag away from drain 206 as product is discharged through the drain 206. Compartments $C_{a,5}$ and $C_{a,6}$ also operate to squeeze product from a limited portion of the back side of the product chamber as the they are inflated.

Figure 3A:
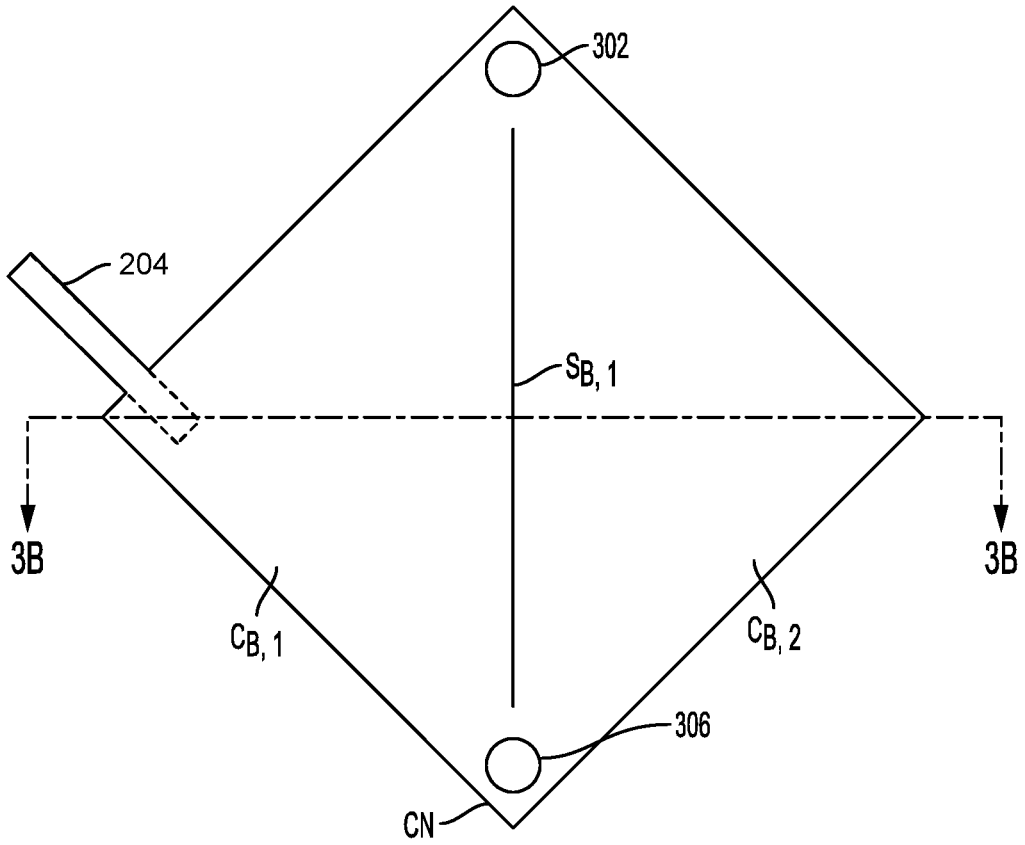
FIGS. 3A-3B are front and cross sectional illustrations, respectively, of still another embodiment of a shipper bag according to aspects of the present invention.
Figure 3B:
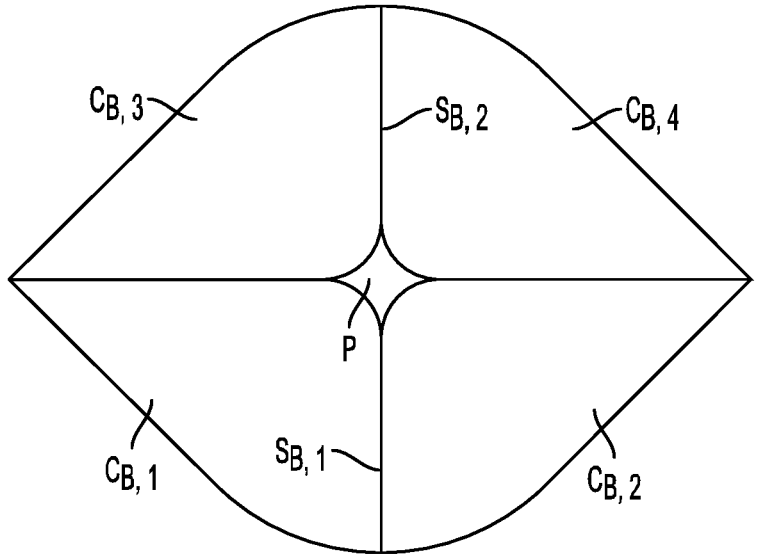

FIGS. 3A-3B are front and cross sectional illustrations, respectively, of still another example of an embodiment of a shipper bag 300 according to aspects of the present invention. In this embodiment, product discharge zone (including drain 306) is located in a corner CN of the bag. When bag is located in a container (e.g., an IBC), with drain 306 located at the bottom of the container, compartments $C_{b,1}$-$C_{b,4}$ (defined in-part by seam $S_{B,1}$ and seam $S_{B,2}$) form a sump sloped toward drain 306. The sump is bounded by the edges of the bag, which help to direct product to drain 306. In FIG. 3B, the fluid chamber is inflated and the product chamber P is nearly empty.

Figure 4A:
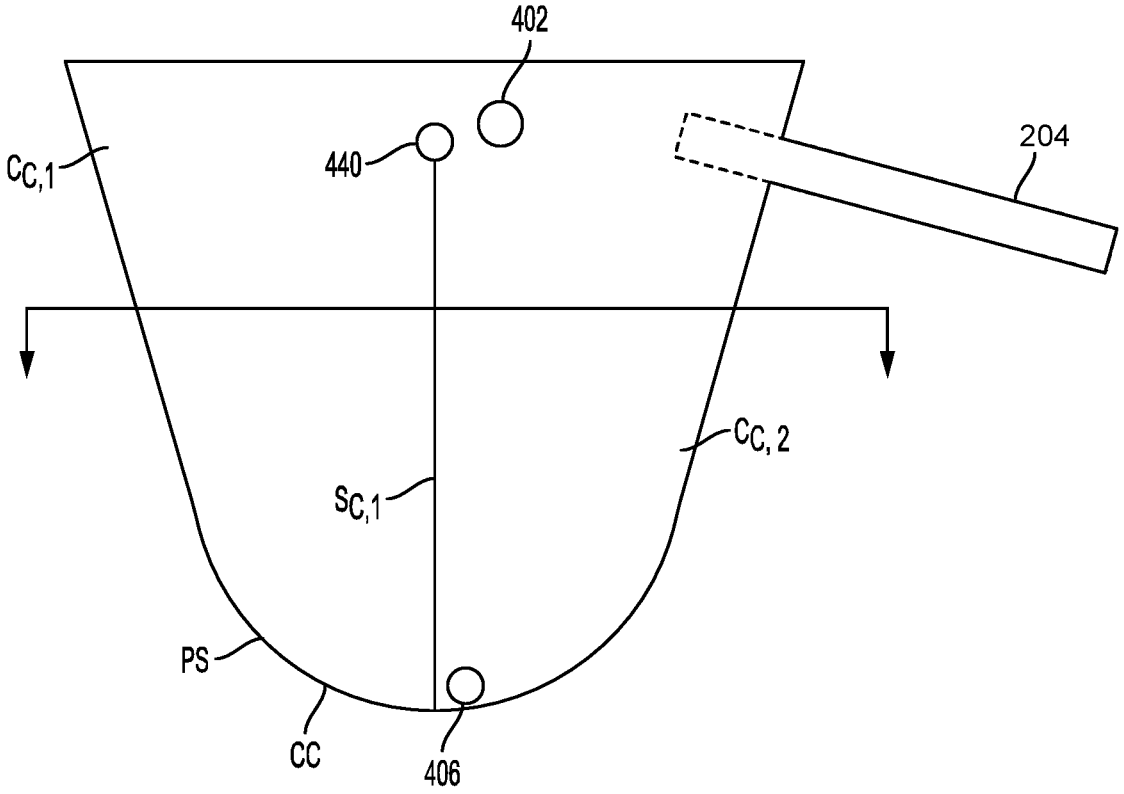
FIGS. 4A-4B are front and cross sectional illustrations, respectively, of still another embodiment of a shipper bag according to aspects of the present invention.
Figure 4B:
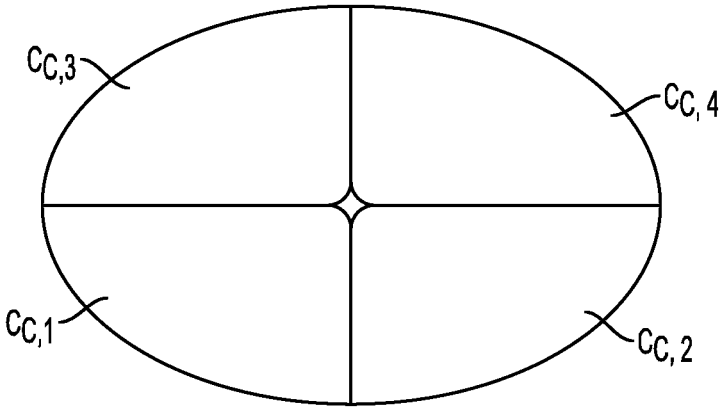
Figure 4C:
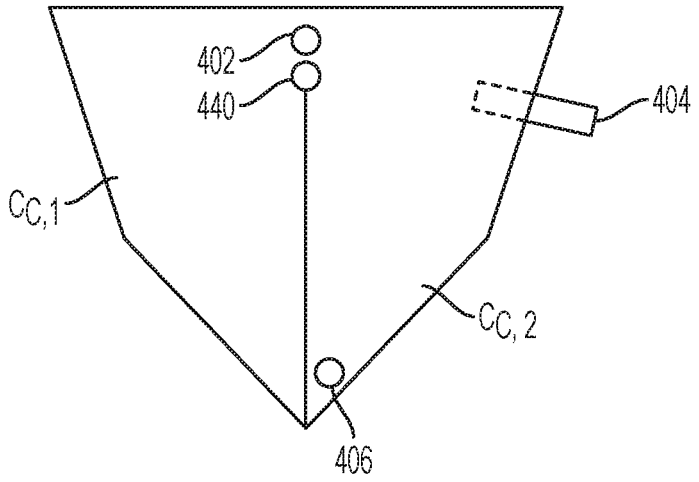
FIG. 4C is a front view of a bag similar to the FIGS. 4A and 4B shipper bag, where the bottom of the bag has an alternative configuration.

FIGS. 4A-4B are front and cross sectional illustrations, respectively, of yet another example of an embodiment of a shipper bag 500 according to aspects of the present invention. Bag 500 is similar to bag 100 described above with several additional features. Only features differing from bag 100 are discussed below.

A part of perimeter seal PS at the bottom of bag 500 is shaped as a concavity CC (and as a result a concavity in the product discharge zone). The concavity faces the interior of the bag. Such a configuration facilities the formation of a sump at the bottom of the bag, and leads to reduction in residual as the fluid chambers inflate. Additionally, the shape provides less total ply material present along the bottom of the bag, which results in the presence of fewer wrinkles as the bag is inflated in a container. The concavity may be formed using a radius at the bottom of the bag, as shown in FIG. 5A or, as shown in FIG. 5C, with one or more straight lines along the bottom of the bag.

Referring again to FIG. 4A, strain relief 440 is added at the top of seam $S_{c,1}$ to reduce the likelihood of tearing at the end of seam $S_{c,1}$ as the compartments $C_{c,1}$-$C_{c,4}$ are inflated.

Figure 4D:
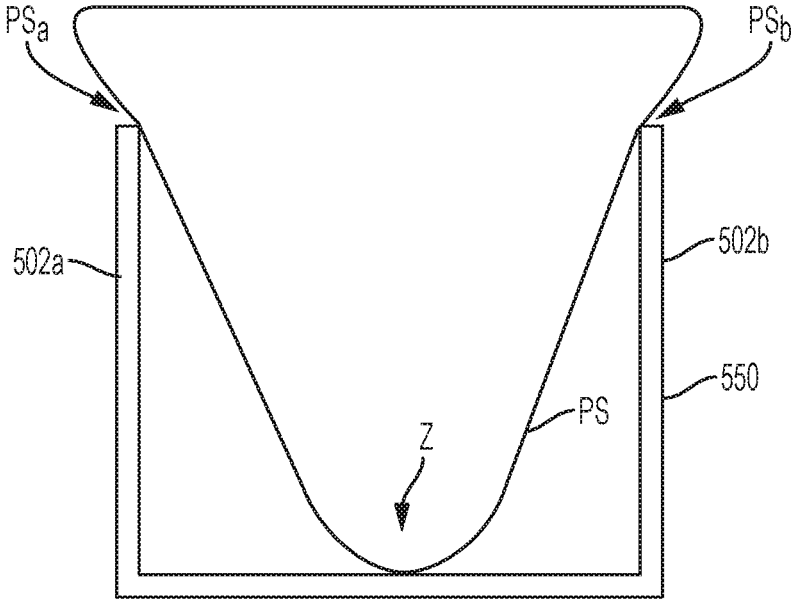
FIG. 4D is a side view of an inflated bag as shown in FIGS. 4A-4B in a container.

As shown in FIG. 4D, portions $PS_a$ and $PS_b$ of perimeter seams PS of the bag 500 are disposed to contact the top of sides 502*a* and 502*b* of container 550. Portions $PS_a$ and $PS_b$ are angled such that an interior surface of each seam faces toward the top of the bag and toward a top of the container. First portion $PS_a$ and second portion $PS_b$ also face one another. When the bag is inflated, first portion $PS_a$ presses against a first side of container 550 and second portion $PS_b$ presses against a second side of container 550, and as a result bag 500 is lifted away from the bottom of the container 550. Such a configuration facilitates movement of the product toward a product discharge zone Z.

Figure 5A:
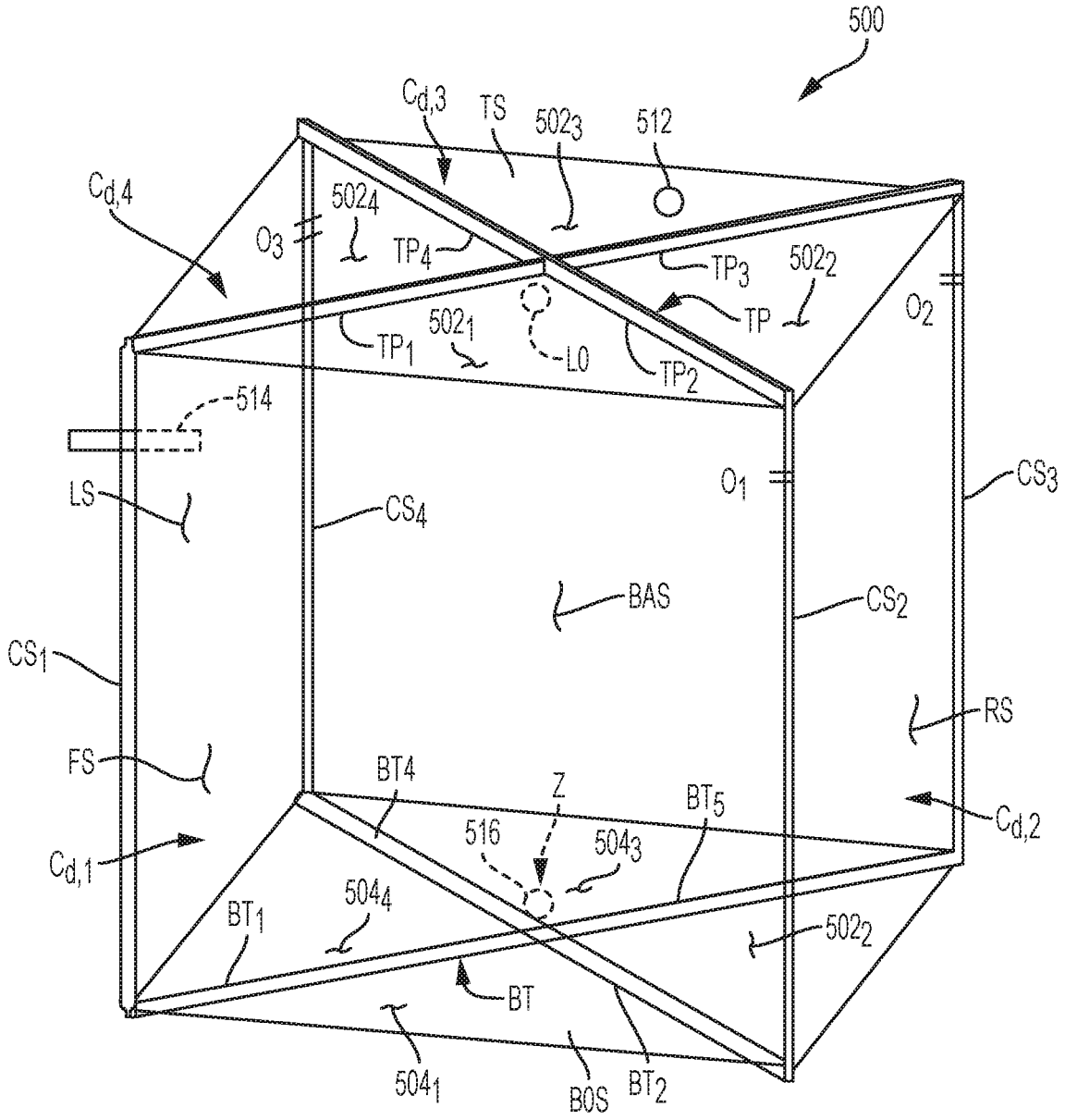
FIG. 5A is a projection view of an embodiment of a fitted shipper bag according to aspects of the present invention.
Figure 5B:
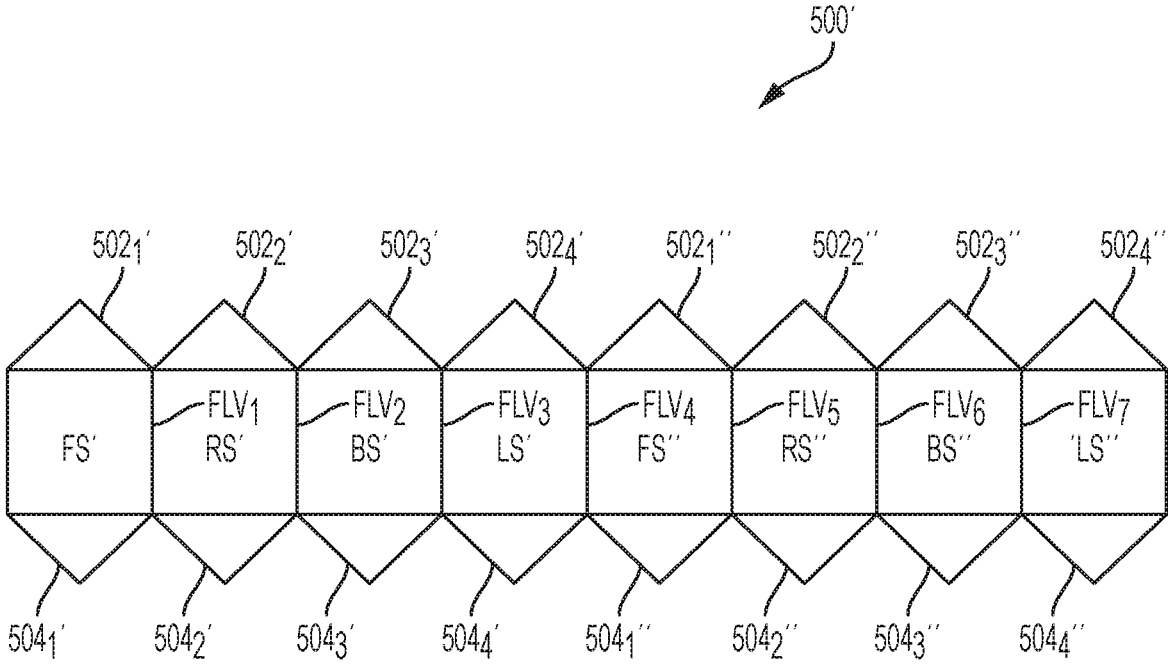
FIG. 5B is a top view of an example of a preform used to make a shipper bag as shown in FIG. 5A.

FIG. 5A is a projection view of an embodiment of a multi-ply, fitted shipper bag 500 according to aspects of the present invention. FIG. 5B is a top view of an example of a preform used to make a multi-ply shipper bag as shown in FIG. 5A. Bag 500 has front side FS, a right side RS, a back side BAS, a left LS, a top side TS and bottom side BOS.

Bag 500 has a fluid chamber comprising four compartments $C_{d,1}$-$C_{d,4}$. Each compartment is formed at a corresponding side FS, RS, BAS and LS and each side extends to portion (e.g., one quarter) of top side TS and a portion (e.g., one quarter) of bottom side BOS. A product inlet 512 and a drain 516 are present to introduce product to the product chamber and remove product from the product chamber.

An interply, corner seam $CS_1$-$CS_4$ is formed at each corner. An X-shaped interply, top seam TP (having four segments $TP_1$-$TP_4$) is formed on top side TS and an X-shaped interply, bottom seam BT (having four segments $BT_1$-$BT_4$) is formed on the bottom side BOS. Each compartment $C_{d,1}$-$C_{d,4}$ is defined by two seam segments $TP_1$-$TP_4$ of the top seam TP and two seam segments $BT_1$-$BT_4$ of bottom seam BT, and two of corner seams $CS_1$-$CS_4$. For example, Compartment $C_{d,}$ 1 is defined by corner seam $CS_1$ and $CS_2$ and segments $TP_1$, $TP_2$, $BT_1$ and $BT_2$.

Each corner seam $CS_1$-$CS_4$ in combination with a corresponding top segment $TP_1$-$TP_4$ and bottom segment $BT_1$-$BT_4$ extends from a location proximate the product discharge zone Z to a location proximate a location opposite LO the discharge zone. A fluid inlet 104 is provided to introduce fluid between plies to the fluid chamber. In some embodiments, each compartment is provided with its own inlet; in some embodiments, an opening may be provided at a corner seams CS to allow fluid to move between two or more compartments $C_{d,1}$-$C_{d,4}$.

Referring to FIG. 5B, a preform as shown may be folded using a 90-degree fold at each fold line $FLV_1$-$FLV_7$ forming a square cylinder, each having an inner and an outer ply (e.g., on the front side FS' and FS" and on the back side BS' and BS"). At each corner of the square cylinder, an inner fold line is sealed to an outer fold line. Each quarter of the inner ply of the top is formed by a corresponding flap 502'$_1$-502'$_4$; and each quarter of the outer ply of the top is formed by a corresponding flap 502"$_1$-504"$_4$. Similarly, each quarter of the inner ply of the bottom is formed by a corresponding flap 504'$_{1-4}$; and each quarter of the outer ply of the bottom is formed by a corresponding flap 504"$_{1-4}$.

Each flap 502', 502", 504' and 504" is oversized so that a portion flap can be used to form a seam with an adjacent flap. Four layers of material are sealed together to form each segment of seam TP and each segment of seam BT. Similarly, each side FS', RS', BS', LS', FS", RS", BS" and LS" is oversized relative to sides FS, RS, BS and LS to allow for formation of corner seams $CS_1$-$CS_4$. Accordingly, a product chamber is formed by inner plies corresponding to each of FS', RS', BS', LS', top flaps 502'$_1$-502'$_4$ and bottom flaps 504'$_1$-504'$_4$, and fluid chamber is formed between the inner plies and outer plies FS", RS", BS", LS", top flaps 502"$_1$-502"$_4$ and bottom flaps 504"$_1$-504"$_4$. It is to be appreciated that a seam is not formed along the perimeter of to surface TS and bottom surface BOS. The fluid chamber formed by compartments $C_{d,1}$-$C_{d,4}$ is disposed over nearly 100% of the surface area of the product chamber when the bag is an uninflated state.

Although various embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. In a shipper bag having at least one fluid chamber to facilitate fluid-assisted container evacuation from a drain conduit of a product chamber, the product chamber formed by at least one inner ply, and the at least one fluid chamber disposed between the at least one inner ply and at least one second ply and the drain conduit extending through the at least one inner ply and the at least one second ply, the at least one fluid chamber having at least one seam connecting a first of the at least one inner ply to a first of the at least one second ply such that, when the at least one fluid chamber is in an inflated state, the at least one seam comprises a first seam that extends from a location proximate the drain conduit to a location proximate a location opposite the drain conduit, the first seam defining in-part a first inflatable portion of the at least one fluid chamber formed by a first portion of the first inner ply and a second inflatable portion of the at least one fluid chamber formed by a second portion of the first inner ply, the at least one fluid chamber sized and shaped such that, when in the inflated state, an interface is formed between the first portion of the first inner ply and the second portion of the first inner ply.

2. The bag of claim 1, wherein the first inflatable portion constitutes a first compartment and the second inflatable portion constitutes a second compartment the first seam separates the first compartment and the second compartment, the first seam having an opening that fluidly couples the first compartment to the second compartment.

3. The bag of claim 2, wherein the at least one seam comprises a second seam connecting the at least one inner ply to the at least one second ply to form a third compartment and a fourth compartment.

4. The bag of claim 3, wherein the first compartment and the second compartment are separated from the third compartment and the fourth compartment by a fold line.

5. The bag of claim 3, wherein the first compartment and the second compartment are on a front face of the bag, and the third compartment and the fourth compartment are on a back face of the bag.

6. The bag of claim 3, wherein the bag is configured such that the first compartment, second compartment, third compartment and fourth compartment form non-coplanar interfaces when the bag is in the inflated state.

7. The bag of claim 2, wherein the first compartment and the second compartment are on a same face of the bag.

8. The bag of claim 1, wherein the first inflatable portion constitutes a first chamber and the second inflatable portion constitutes a second chamber, and the first seam separates the first chamber and the second chamber.

9. The bag of claim 1, wherein the at least one fluid chamber is disposed over at least 50% of the surface area of the product chamber when the bag is an uninflated state.

10. The bag of claim 1, wherein the at least one fluid chamber is disposed over at least 75% of the surface area of the product chamber when the bag is an uninflated state.

11. The bag of claim 1, wherein the bag includes a product discharge zone, and the bag has a perimeter seal in the product discharge zone, and wherein the bag is configured such that, when in the inflated state, the perimeter seal is shaped as a concavity facing the interior of the bag.

12. The bag of claim 11, wherein the concavity is formed as a plurality of straight line portions of the perimeter seal.

13. The bag of claim 1, the bag having at least one perimeter seal, wherein, the bag is configured such that when in the inflated state, a first portion of the at least one perimeter seal has an interior surface that is angled to face a top of the bag, and a second portion of the at least one perimeter seal having an interior surface that is facing the first portion and is angled to face the top of the bag.

14. The bag of claim 13 in combination with a container, the drain conduit disposed in a product discharge zone disposed at a bottom of the container, the bag being inflated such that the first portion contacts a top of a first side of the container and the second portion contacts a top of a second side of the container.

15. The bag of claim 1, wherein the bag is a fitted bag.

* * * * *